US005329835A

United States Patent [19]

Timp et al.

[11] Patent Number: 5,329,835

[45] Date of Patent: Jul. 19, 1994

[54] ADJUSTABLE LENGTH PUNCH SET ASSEMBLY

[75] Inventors: Richard L. Timp, Vadnais Heights; Michael W. Schultz, Wayzata; John H. Morehead, White Bear Lake, all of Minn.

[73] Assignee: Wilson Tool International, Inc., White Bear Lake, Minn.

[21] Appl. No.: 958,021

[22] Filed: Oct. 7, 1992

[51] Int. Cl.[5] ..... B26F 1/14

[52] U.S. Cl. ..... 83/686; 83/698.71

[58] Field of Search ..... 83/700, 686, 684, 697

[56] References Cited

U.S. PATENT DOCUMENTS

| | | | |
|---|---|---|---|
| 3,848,496 | 11/1974 | Stevens et al. | 83/133 |
| 3,926,082 | 12/1975 | von Langendorff | 83/140 |
| 4,012,975 | 3/1977 | LaLone | 83/140 |
| 4,031,787 | 6/1977 | Cady | 83/140 |
| 4,141,264 | 2/1979 | Weisbeck | 83/23 |
| 4,375,774 | 3/1983 | Wilson et al. | 83/140 |
| 4,440,052 | 4/1984 | Weisbeck | 83/140 |
| 5,020,407 | 6/1991 | Brinlee | 83/530 |
| 5,054,347 | 10/1991 | Johnson et al. | 83/700 X |

*Primary Examiner*—Richard K. Seidel
*Assistant Examiner*—Kenneth E. Peterson
*Attorney, Agent, or Firm*—Fredrikson & Byron

[57] ABSTRACT

An adjustable length punch set assembly for adjusting the overall length of a punch having a punch driver and punch holder that are axially adjustable relative to each other and retained at least in part within a punch guide sleeve and biased axially with respect thereto by a biasing spring. A locking push button is positioned axially within and accessible through a hole of the punch driver, the push button being moveable between a first position for locking the punch driver with respect to the punch holder to prevent length adjustment by rotation of mutually engageable threaded portions thereof, and a second position allowing relative rotation of the punch driver and punch holder along the mutually engageable threaded portions to effect length adjustment. The push button includes one or more detents formed thereon, the detents being engageable with one or more first detent stop(s) formed in the punch driver and second detent stop(s) formed in the punch holder. The number of second detent stops in the punch holder preferably is less than the number of first detent stops of the punch driver, such that the number of first detent stops in an integer multiple of the one or more detents of the push button. A spring is provided for biasing the locking push button into the first position. The spring is depressible by an external force applied through the hole in the punch driver to the push button thereby moving the push button into the second position.

10 Claims, 3 Drawing Sheets

ADJUSTABLE LENGTH PUNCH SET ASSEMBLY

BACKGROUND OF THE INVENTION

1. Cross-Reference to Related Application

Reference is directed to commonly assigned co-pending U.S. patent application Ser. No. 07/958,019 filed on even data herewith in the names of Ronald G. Rosene, Richard L. Timp, and John H. Morehead, and entitled LOCKING RING STRIPPER PLATE ASSEMBLY.

2. Technical Field

The invention relates generally to punch set assemblies used in punch presses, and particularly to adjustable length punch set assemblies wherein the punch may be adjusted to compensate for punch blade length reduction due to sharpening.

3. Description of the Prior Art

Repeated use of a punch assembly in a punch press operation results in the natural dulling and wear of the punch blade or tip. Once the tip has become dull, the effectiveness of the punch assembly is reduced and the punch tip must be sharpened. Sharpening may be accomplished by grinding the end of the punch tip, and this results in shortening the length of the blade and, consequently, the punch. The length of the punch then must be adjusted to compensate for the ground-off portion of the punch blade.

A first type of punch set assemblies that allow for length corrections are exemplified in U.S. Pat. Nos. 4,031,787 and 4,141,264. These patents disclose punch sets that compensate for the shortened punch blade length by adding shims, washers or other similar objects to the punch. The problem with this method is that the added washers or the like are usually weak and cannot withstand the constant cyclical forces placed upon a punch. Also, the length of the punch tip can only be adjusted within certain limits before it becomes too short for effective operation, thereby limiting the number of times the punch tip can be sharpened. In addition, most such methods that allow for the adjustment of the length of the punch tip require dismantling of the entire punch in order to access the punch tip for adjustment; this obviously can be a rather time-consuming process. Additionally, once the punch has been reassembled, further effort is frequently expended in determining how much the sharpening and adjusting steps have affected the axial position of the tip with reference to the plane of the stripper plate opening that it extends through in use.

Improvements on these known methods are described in commonly assigned U.S. Pat. No. 4,375,774 and in co-pending U.S. patent application Ser. No. 743,689 filed Aug. 12, 1992, now U.S. Pat. No. 5,131,303. In the '774 patent and the '689 application, the punch driver and punch holder or body components of the punch are attached by mutually engageable threaded portions so that overall punch length adjustment may be accomplished by rotation of the threaded portions so that the punch tip may be properly aligned with the opening in the stripper plate. Locking mechanisms are provided in each case. In the '774 patent, an expandable locking pin is inserted into aligned locking pin holes wherein it interferes with and prevents rotation of the threaded portions. While simplifying the axial length adjustment process, this approach requires removal and re-insertion of the locking pin.

In the '689 application, the assembled punch is axially slidably received within a bore provided in a punch guide. A releasable lock for locking the threaded ends against relative rotation is provided by an arcuate wire clip having a radially inwardly extending cam pin. The arcuate clip is retained in an annular groove and radially inwardly extending bore in the punch holder so that the cam pin extends inwardly and into engagement with a set of circumferentially distributed grooves in the male threaded end of the punch body. Length adjustment in either direction is provided by rotating the punch body with respect to the punch holder so that the cam tip is released from one groove and engages a further groove. Such adjustable length punch sets are useful for relatively small diameter punch sets.

An adjustable length forming tool head is disclosed in U.S. Pat. No. 5,020,407 which discloses a length adjustment in the threaded connection between the punch driver and the punch head base which in turn is attached to a form tool body. A length control ring member is spring biased away from and between the driver and the base and is formed with a central opening for engaging the shaft of the driver to prevent their relative rotation and a set of circumferentially spaced apertures for engaging a pair of pins extending from the base. Adjustment is accomplished by grasping the ring member and driver to withdraw the ring member from engagement with the pins and to rotate them until the next desired set of diametrically opposed apertures is aligned with the pins. Since the form tool does not have a punch set spring encircling the punch head, it is possible to grasp the ring member and make the length adjustment. Such an arrangement would not be useable in punch sets having a punch spring encircling the punch head, driver and holder components of the type disclosed in the above referenced patents and application.

A need exists, therefore, for an accurate means of adjusting the length of the punch in a manner that is not overly time consuming or difficult.

SUMMARY OF THE INVENTION

It is thus an object of the present invention to provide a readily adjustable punch set assembly for use in a punch press that may be manipulated manually without the use of tools and provide a fine, high resolution, reliable length adjustment particularly for use in heavy duty wide body punch sets.

In accordance with one aspect of the present invention, an adjustable length punch set assembly is provided for adjusting the overall length of a punch having first and second axially adjustable punch components and retained at least in part within a punch guide sleeve and biased axially with respect thereto by a biasing spring. Push button locking means for locking said first punch component with respect to said second punch component and for preventing length adjustment by relative movement of said first and second punch components in a locking position thereof and for allowing relative movement of said first and second punch component in a release position thereof, said locking means further comprising a locking component having at least one locking detent formed thereon; means for retaining said at least one detent in engagement with a corresponding first detent stop means formed in said first punch component in both said locking and release positions of said locking component; a plurality of second detent stop means in said second axially adjustable punch component for providing a plurality of possible engageable orientations of said at least one detent with respect to said second axially adjustable component; biasing means for biasing said at least one detent of said locking component in locking engagement with one of said second detent stop means formed in said second component; and means for applying force against said biasing means for releasing said at least one detent of said locking component from engagement with said selected second detent stop means formed in said second component and allowing movement of said locking component to the release position and allowing relative axially adjustment of said first and second punch components to thereby adjust the length thereof.

In the preferred embodiment of the present invention, the length control mechanism comprises an adjustable push button and a biasing spring mounted within a cavity formed within the threaded portions of the punch driver and punch holder, a thumb access hole formed axially within the capped head of the punch driver and extending into the cavity and formed with a plurality or detent stops equally spaced in a circle around the periphery of the through-hole, the adjustable push button block having a circular portion adapted to extend into the through-hole to allow relative rotation of the adjusting push button and the punch driver and a block-shaped portion having a plurality of edges and shoulders forming detents configured to engage with a set of the detent stops of the punch driver under the force applied by the biasing spring. In use, the locking mechanism prevents the relative rotation of the threaded portions of the punch driver and punch holder unless the operator manually depresses the circular portion to depress the adjusting push button block-shaped portion and release its shoulders from engagement with the detent stops formed within the punch driver, whereupon the punch driver may be rotated to thread it further onto or off from the threaded portion of the punch holder thereby decreasing or increasing the overall length of the punch.

The punch blade attached to the punch holder extends through a stripper plate attached to the punch sleeve (which in turn typically, slidably engages with the punch holder and the punch driver against the biasing force of a punch spring), so that the operator may observe the distance by which the punch blade extends through an opening in the stripper plate and thereby adjust the punch length until the punch blade is properly axially aligned with the plane of the opening in the stripper plate that the punch blade or tip extends through.

In accordance with the present invention, the length adjusting mechanism is readily accessed directly through the punch driver capped head so that it is unnecessary to remove the punch spring or any other components of a heavy duty, wide body punch set in order to make the length adjustment.

The present invention thus provides such a readily adjustable, reliable punch set assembly for use in a punch press.

BRIEF DESCRIPTION OF THE DRAWINGS

These and other objects advantages and features of the present invention will become apparent from the following detailed description of the preferred embodiments thereof taken in conjunction with the drawings in which.

DETAILED DESCRIPTION OF THE PREFERRED EMBODIMENTS

Figure 1:
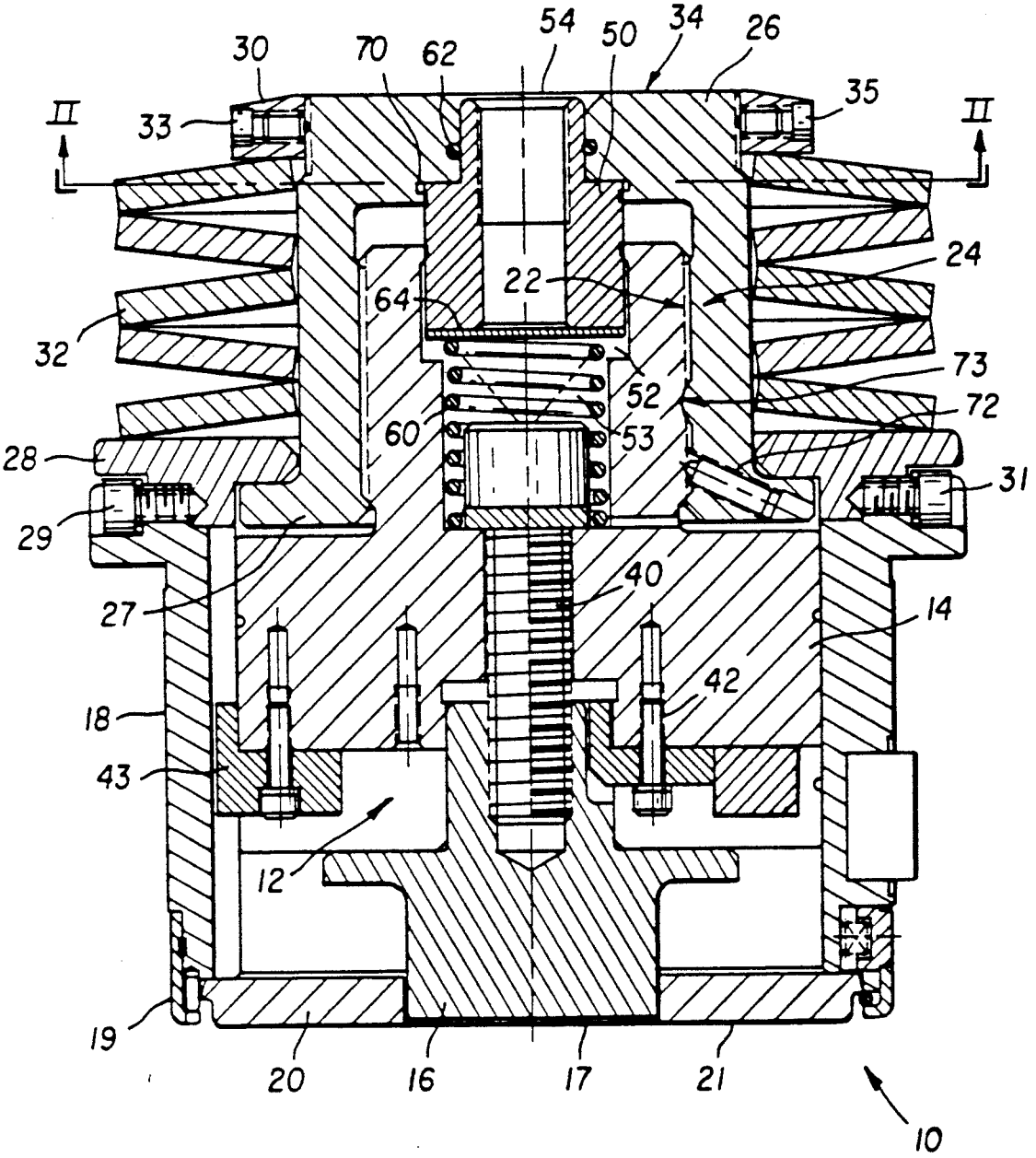
FIG. 1 is an axial, partial cross-sectional view of a punch set assembly of the present invention.

The principles of this invention relate to the workings of a punch set that comprises a punch sleeve, an internally disposed punch body having a punch blade or tip, a punch holder attached to or formed integrally with the punch body, a stripper plate having an opening for the punch blade or tip formed integrally with the punch sleeve or attached thereto, a punch driver attached to the punch holder and a punch spring for biasing the punch driver away from the punch sleeve and attendant and related parts which form the punch set assembly. Accordingly, the invention is appropriate for the numerous applications concerning punch presses, including, but not limited to, single station and turret presses.

A preferred embodiment of a punch set assembly 10 of the present invention is exemplified in the drawings as comprising a punch holder 14 and a replaceable punch blade 16 (together referenced as punch 12) disposed centrally within a punch sleeve 18, wherein the punch blade 16 extends through an opening 17 in a stripper plate 20. The punch holder 14 has a threaded male portion 22 extending upward and screwed into engagement with a threaded female portion 24 of punch driver 26. A spring support ring 28 and an annular spring retaining nut 30 retain the spring 32 encircling the punch driver 26. The spring support ring 28 is attached by cap screws 29 and 31 to the punch sleeve 18 and bears against the flange 27 of the punch driver 26 to retain it and the spring 32 in the position depicted in FIG. 1. The threaded retaining nut 30 is locked from rotating about punch driver 26 by a further pair of cap screws 33 and 35.

As can be seen in FIG. 1, the punch blade 16 is attached to the punch holder 14 by a relatively large hex head cap screw 40 threaded axially into a threaded bore of punch blade 16. A keyway and guide assembly 42 is provided to lock the punch blade 16 from rotating on the cap screw 40 as is conventional in the art. A further conventional elongated slot and keyway assembly 43 guides the assembled punch's reciprocal movement within the sleeve 18. The stripper plate 20 is removably attached to the sleeve 18 by a retaining cap assembly 19 in a manner described more completely in the above-referenced Ser. No. 07/958,019. The female and male threaded portions 24 and 22 of the punch driver 26 and punch holder 14 may be unlocked and rotated with respect to one another to lengthen or shorten the axial punch 12 length in a manner to be described.

In a punching operation, a ram (not shown) strikes downwardly on the capped head 34 of the punch driver 26, compressing the compression spring 32 and urging the punch 12 components downwardly until the punch blade 16 protrudes below the lower face 21 of the stripper plate 20. The protruding punch blade 16 passes through a workpiece (not shown) of a sheet material and into a die casting (not shown) to punch an item out of the workpiece having the desired shape. The punch assembly is adaptable to a variety of punch blade shapes attached by cap screw 40 and matching stripper plates 20 depending upon the shape desired to be removed from the workpiece.

The ram is then retracted, releasing the compressive force on the spring 32. The spring 32 then acts against the retaining nut 30, which it abuts, to draw the punch driver 26 and attached punch 12 upward. When the punch blade 16 is retracted upwardly through the aperture 17 in the stripper plate 20, it engages the workpiece, which often sticks to the retreating punch blade 16, and separates it from the punch blade 16.

In particular regard to the length adjustment mechanism of the present invention, the male threaded portion 22 is sized to be matingly received within the female threaded portion 24, and the threads on the male and female portions are adapted to matingly engage one another. As the punch driver 26 and spring 32 are rotated with respect to the punch holder 14, the punch 12 will move axially with respect to the punch driver 26 as long as the length adjustment mechanism does not lock the punch driver 26 to the punch holder 14. If the pitch of the mating threads is known, the relationship between the degree of relative rotation of these members and the resultant axial movement can be readily determined. Thus, the overall length of the punch can be precisely adjusted by axially rotating the punch driver 26 and spring 32 with respect to the punch holder 14 through a known angle, depending on the resolution of the locking mechanism.

In the preferred embodiment of the present invention, the mating threads of the male and female portions 22 and 24 are cut at a 1/10th inch pitch which translates axially to a lengthening or shortening of 0.100 inches per complete 360° revolution.

The length adjustment mechanism of the present invention comprises the adjusting length push button 50 that is fitted into an axially elongated cavity 52 extending from a through-hole 54 in the cap surface 34 of the punch driver 26 into the interior of the threaded portion 22 of the punch holder 14, a biasing spring 60 and retaining washer 61 fitted into an extension 53' of the cavity 52, and an O-ring 62 in a groove in the through-hole 54, all as shown and described in relation to the remaining figures. Generally, the adjusting length push button 50 is seated in the extension 53' of cavity 52 such that it cannot be rotated with respect to the punch holder 14 and biased by the spring 60 into engagement with a set of detent stops 70 formed in the interior surface of the punch driver 26 to lock the punch driver 26 to the punch holder 14 to prevent the relative rotation of the threaded portions 22 and 24.

Generally, when it is desired to rotate portions 22 and 24 to adjust the length of the punch 12, the operator removes the sleeve 18 and attached stripper plate 20 by unscrewing cap screws 29 and 31. Usually then the punch 16 is either replaced or is dressed to resharpen or shape the blade. Then, the operator depresses the adjusting length push button 50 extending through the hole 54 to release it from engagement with the detent stops formed in the punch driver 26 while simultaneously rotating the punch driver 26 and the spring 32 with respect to the punch holder 14. The specific elements of the locking mechanism that enable the adjustment are as follows.

Figure 2:
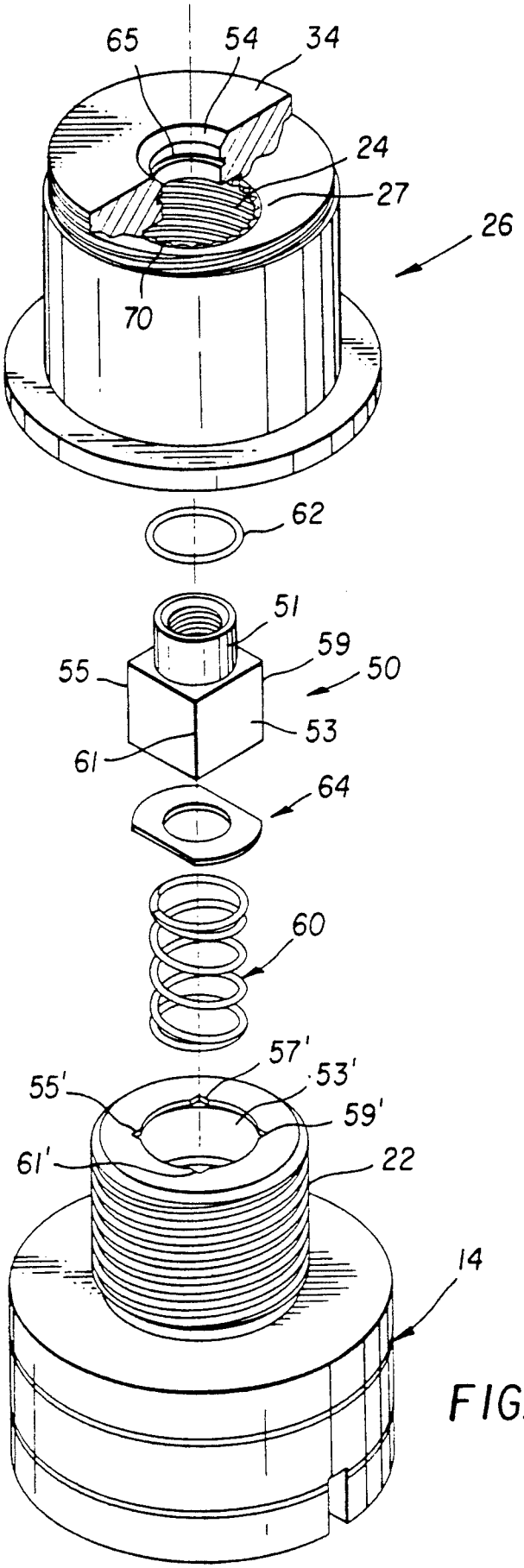
FIG. 2 is an exploded, perspective view of the adjustable length mechanism of the present invention implemented in a preferred embodiment thereof.

Turning now to FIG. 2, it depicts in an exploded perspective view the relation of the component parts of the length adjustment mechanism of the present invention depicted in FIG. 1. In FIG. 2, it may be seen that the adjusting length push button element 50 comprises a circular button portion 51 that extends through the circular hole 54 in the punch driver 26 and a square block 53 having four corners 55, 57, 59 and 61. The circular button portion 51 slides axially under thumb pressure against an O-ring 62 fitted into groove 63 in the hole 54 and encircling the button portion 51.

The four corners 55, 57, 59, 61 of the push button 50 act as detents that are adapted to engage with a set of four of the twenty-four detent stops 70 in the top interior surface 27 adjacent to the hole 54 of the punch driver 26 (also shown in FIG. 5) and engage the four detent stops 55', 57', 59', and 61' formed within the extension 53' of the cavity 52 formed axially in the punch holder 14. The bottom surface of the square block 53 bears against a retaining washer 61 and the biasing spring 60 which in turn bears against an interior surface of the extension 53' of the cavity 52. The washer 61, when fitted into the extension 53' against spring 60, retains spring 60 partially compressed.

Figure 3A:
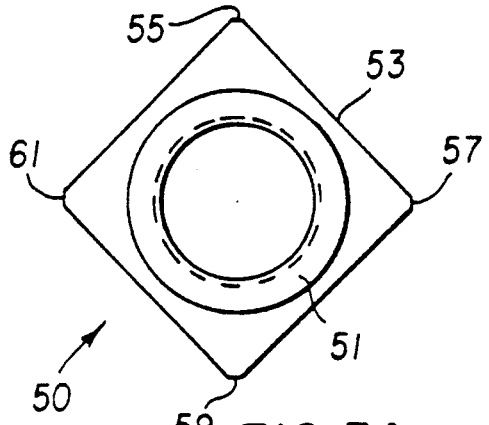
FIGS. 3A-3C are top plan, side cross-section, and bottom plan views of the adjusting length push button lock employed in the punch set assembly of the preferred embodiment of the present invention.
Figure 3B:
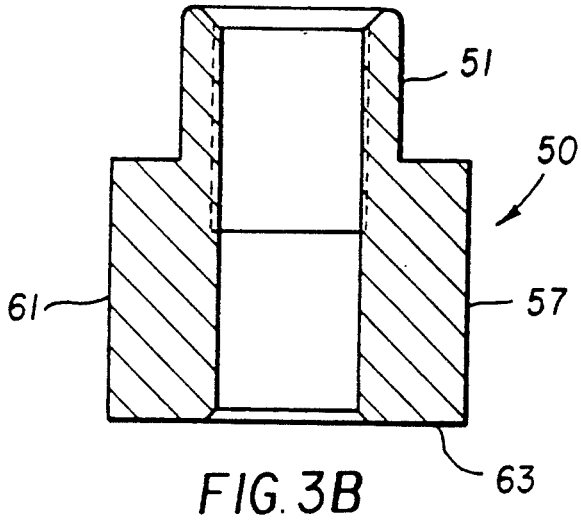
Figure 3C:
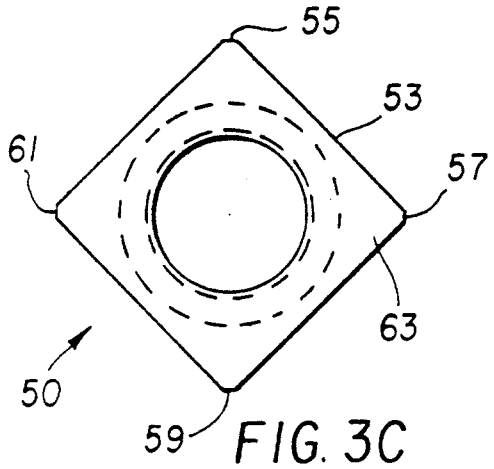

Referring now to FIGS. 3A–3C, they depict in top, side cross-section, and bottom views the shape of the push button 50. The corners 55, 57, 59, and 61 are slightly squared as depicted in FIG. 3C in order to deburr the sharp edges to avoid catching on the detent stops.

Figure 4:
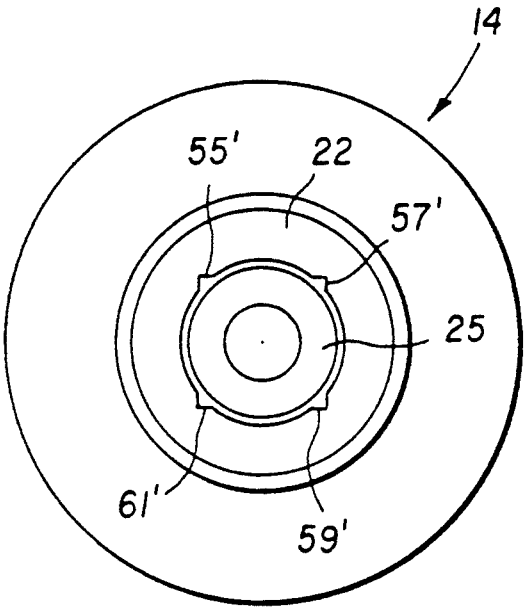
FIG. 4 is a top plan view of the punch holder of the punch set assembly of FIG. 1.

Turning now to FIG. 4, it depicts a top view of the punch holder 14 particularly showing the squared corners or detent stops 55', 57', 59', and 61' of the interior surface adapted to engage with and receive the detents 55, 57, 59 and 61 of the adjusting length push button 50. Thus, when the push button 50 is seated in the extension 53 of the cavity 52 as shown in FIG. 1, it cannot rotate with respect to the punch holder 14.

Figure 5:
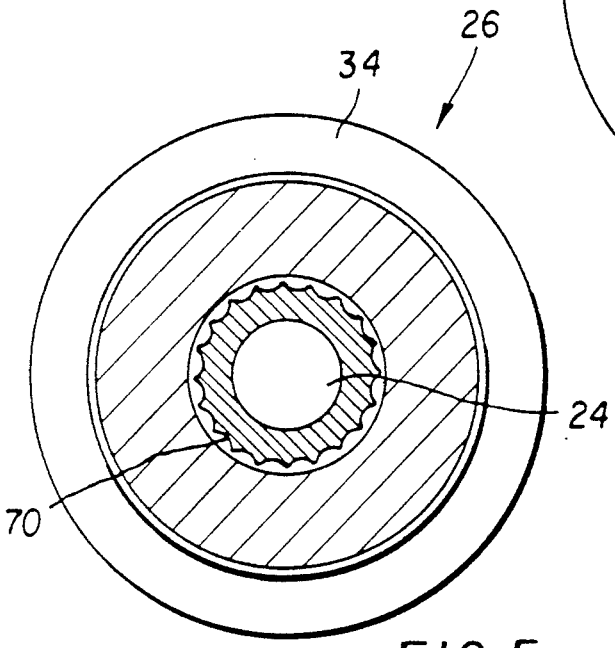
FIG. 5 is a cross-section view taken along lines II—II of the punch driver depicted in FIG. 1.

Referring now to FIG. 5, it depicts, in a cross-section view taken long lines II—II in FIG. 1, the interior surface of the punch driver 26 and particularly the plurality of detent stops 70 arranged circumferentially around the hole 24 and against which the corners 55, 57, 59 and 61 rest in the position depicted in FIG. 1. In this embodiment, twenty-four detent stops 70. The punch driver, for example, may be rotated in 15° increments by the provision of the twenty-four separate positions afforded by the twenty-four detent stops 70. With the 1/10th inch pitch, this works out to an axial incremental length resolution of 0.100 inches/24 or about 0.004 inches per 15° rotation from one set to the next adjacent set of detent stops 70.

In practice, the punch set assembly 10 is used to punch items having a desired shape from a larger workpiece in a manner well known in the art. After the punch blade has worn and become dull due to repeatedly striking a workpiece, the punch assembly is removed from its turret or machine for sharpening and the sleeve 18 is removed as described above. After sharpening, the length of the punch is shortened by whatever length was ground off. To compensate for this lost length, the push button 50 is depressed and the punch driver 26 is rotated with respect to the punch holder 14. The proper axial spacing of the punch blade 16 to the plane of the opening 17 in the stripper plate 20 can be counted off is 0.004 inch increments, and the push button released so that it is again locked as described above. The actual resulting length may be measured before re-assembly of the sleeve 18.

Referring back to FIG. 1, a spring loaded detent button 72 is provided in the flange 27 of the punch driver 26 that locks into a notch cut in the male threaded portion 22 of the punch holder 14 after the punch has been shortened severely in order to prevent the continued use of a completely worn down punch 16.

While a preferred embodiment of the present invention has been described, it should be understood that various changes, adaptation and modifications may be made therein without departing from the spirit of the invention and the scope of the appended claims.

What is claimed is:

1. An adjustable length punch assembly permitting length adjustment without disassembly thereof, the punch assembly comprising:

(a) a punch driver having a hole formed axially therein and containing at least one detent stop;

(b) a punch holder carried by the punch driver and axially adjustable with respect to the punch driver, the punch holder having at least one detent stop;

(c) push button locking means having at least one detent, the push button locking means being positioned axially within and for access through the hole of the punch driver with the at least one detent being engageable with the detent stops of the punch driver and punch holder, the push button locking means being axially movable between a first position in which the at least one detent engages the detent stops of both the punch driver and punch holder to prevent axial movement therebetween, and a second position in which the at least one detent disengages one or the other of said detent stops to enable axial movement of the punch holder with respect to the punch driver; and (d) biasing means for biasing the push button locking means into the first position.

2. An adjustable length punch assembly permitting the adjustment of its overall length without disassembly, the punch assembly comprising:

(a) a punch driver having a hole formed axially therein, and containing at least one first detent stop;

(b) a punch holder carried by the punch driver, the punch holder and punch driver each having mutually engageable threaded portions thereon permitting axial adjustment therebetween of one of the threaded portions with respect to the other, the punch holder having a cavity formed axially therein and aligned with the hole in the punch driver and having at least one second detent stop;

(c) push button locking means having at least one detent, the push button locking means being positioned axially within the cavity in the punch holder and accessible through the hole in the punch driver with the at least one detent being engageable with the detent stops of the punch driver and punch holder, the push button locking means being axially movable between a first position in which the at least one detent engages the detent stops of both the punch driver and punch holder to prevent relative rotation therebetween, and a second position in which the at least one detent disengages one or the other of said detent stops to enable relative rotation of the punch holder with respect to the punch driver; and (d) biasing means for biasing the push button locking means into the first position.

3. The adjustable length punch assembly of claim 2, wherein the punch driver includes a plurality of first detent stops formed circumferentially around the hole formed axially therein.

4. The adjustable length punch assembly of claim 2, wherein the punch holder includes a plurality of second detent stops formed circumferentially around the cavity formed axially therein.

5. The adjustable length punch assembly of claim 2, wherein the punch driver and punch holder each include a plurality of detent stops formed circumferentially about the hole and cavity respectively.

6. The adjustable length punch assembly of claim 5, wherein the number of the plurality of second detent stops is less than the number of the plurality of first detent stops, the number of the first detent stops being an integer multiple of the second detent stops, and the number of second detent stops being alignable with a like number of first detent stops by rotating the punch driver and punch holder with respect to each other.

7. The adjustable length punch assembly of claim 6, wherein the push button locking means comprises a plurality of detents corresponding in number and position to the plurality of second detent stops formed in the punch holder, the plurality of detents of the push button means being engageable with a like number of first detents formed in the punch driver while in the said first position.

8. The adjustable length punch assembly of claim 2, wherein the biasing means comprises a spring positioned within the cavity formed axially in the punch holder, the spring urging the push button locking means into the first said position.

9. The adjustable length punch assembly of claim 2, wherein a portion of the push button locking means extends through the hole of the punch driver allowing an external force to depress the spring moving the push button locking means into the second said position.

10. An adjustable length punch assembly permitting length adjustment without disassembly thereof, the punch assembly comprising:

(a) a punch driver having a hole formed axially therein and containing a plurality of first detent stops formed circumferentially about the hole;

(b) a punch holder carried by the punch driver, the punch holder and punch driver each having mutually engageable threaded portions thereon permitting axial length adjustment by rotating the threaded portions with respect to each other, the punch holder having a cavity formed axially therein and aligned with the hole in the punch driver and having a plurality of second detent stops formed circumferentially about the cavity, wherein the number of the plurality of second detent stops is less than the number of the plurality of first detent stops, the number of the first detent stops being an integer multiple of the number of second detent stops, and the number of second detent stops being alignable with a like number of first detent stops by rotating the punch driver and punch holder;

(c) a push button locking means having a plurality of detents corresponding in number and position to the plurality of second detent stops formed in the punch holder, the push button means being positioned axially within the cavity of the punch holder and accessible through the hole of the punch driver with the plurality of detents being engageable with a like number of detent stops of the punch driver and punch holder, the push button locking means being axially moveable between a first position in which the plurality of detents engages a like number of detent stops of both the punch driver and the punch holder to prevent axial movement therebetween, and a second position in which the plurality of detents disengages one or the other of said detent stops to enable axial movement of the punch holder with respect to the punch driver;

(d) a spring positioned with the cavity formed axially in the punch holder, the spring urging the push button locking means into the first said position, and being depressible by an external force applied through the hole in the punch driver to the push button locking means thereby moving the push button means into the said second position.

* * * * *